United States Patent [19]

Lorenzini

[11] 4,250,995

[45] Feb. 17, 1981

[54] CARRYING CASE

[76] Inventor: Robert A. Lorenzini, 603 S. State Rd. 7, Margate, Fla. 33068

[21] Appl. No.: 52,833

[22] Filed: Jun. 28, 1979

[51] Int. Cl.[3] ..... B65D 81/08; A45C 11/00

[52] U.S. Cl. ..... 206/314; 206/372

[58] Field of Search ..... 206/314, 379, 380, 382, 206/372; 220/21; 312/42

[56] References Cited

U.S. PATENT DOCUMENTS

| | | | |
|---|---|---|---|
| 623,594 | 4/1899 | Burt | 312/42 |
| 1,997,820 | 4/1935 | Govoni | 206/314 |
| 2,600,589 | 6/1952 | Swanson | 206/380 |
| 2,771,182 | 11/1956 | Messmer | 206/382 |
| 2,919,796 | 1/1960 | Pressl | 206/379 |
| 2,928,534 | 3/1960 | Chill | 206/382 |

*Primary Examiner*—William T. Dixson, Jr.

*Attorney, Agent, or Firm*—Richard A. Menelly; Francis X. Doyle

[57] ABSTRACT

A carrying case for the accessories including reeds used with woodwind instruments. An insert is provided within the case and has a multiplicity of flat surfaces located longitudinally on its outside surface for holding reeds with an opening extending longitudinally within the insert for storage.

9 Claims, 1 Drawing Figure

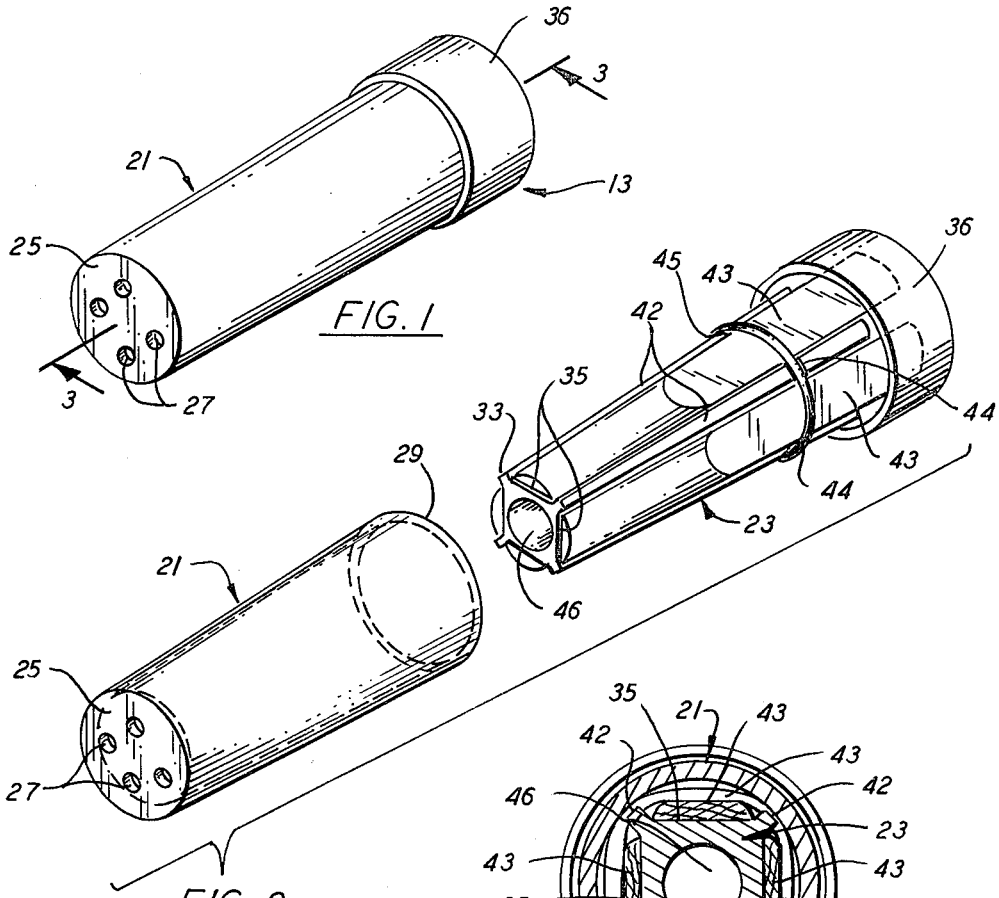
FIG. 1
FIG. 2
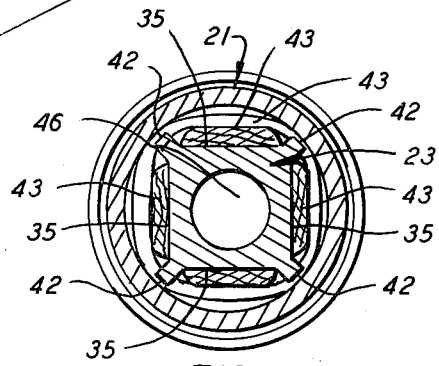
FIG. 4
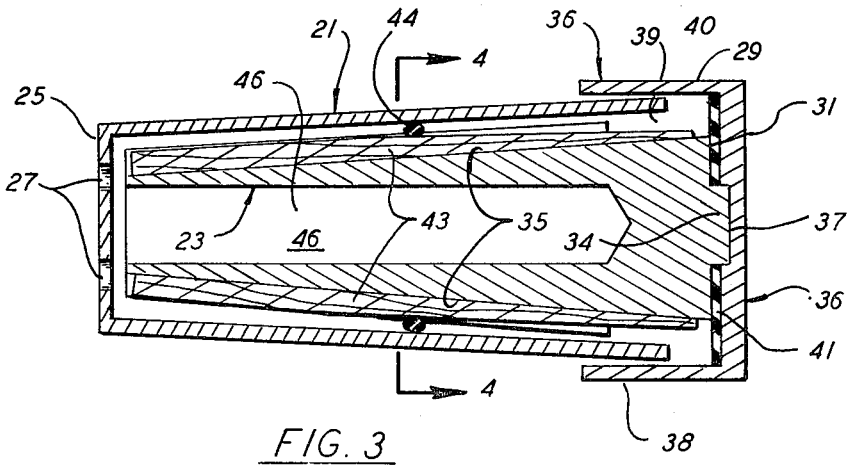
FIG. 3

CARRYING CASE

BACKGROUND OF THE INVENTION

With a woodwind instrument, such as a saxophone or clarinet, a reed is secured to the mouthpiece by a ligature. It is usual for a woodwind instrument musician to carry several reeds when performing since the reeds are easily damaged and the life of a reed is limited.

The spare reeds are usually stored by musicians in a make-shift manner within the case in which the instrument is carried. Various containers, such as envelopes, may be used for storage and carrying such items; but, generally speaking, the various accessories needed by the woodwind instrument musician are spread about resulting in loss and damage.

SUMMARY OF THE INVENTION

This invention relates to a carrying case for the reeds used with woodwind instruments. The novel features which are considered as characteristic of the invention are set forth with particularity in the appended claims. An insert is provided which has a multiplicity of flat surfaces located longitudinally along the outer surface of the insert. A cap is located at one end of the insert. Flat reeds are stored on the flat surfaces and are held in place by a retainer and the cap. An opening is located longitudinally within said insert which can be used to provide a storage space for a container of cork lubricant. A tube slides over the insert as a cover.

The invention itself, however, as to its construction and obvious advantages will be best understood from the following description of the specific embodiment when read with the accompanying drawings.

DESCRIPTION OF THE DRAWINGS

FIG. 1 is a perspective view of the carrying case in its closed position.

FIG. 2 is a perspective view of the carrying case with the tube and insert separated and with reeds located on the insert.

FIG. 3 is a cross-sectional view along line 3—3 of FIG. 1.

FIG. 4 is a cross-sectional view along line 4—4 of FIG. 3.

DETAILED DESCRIPTION OF THE PREFERRED EMBODIMENTS OF THE INVENTION

Although the description hereof is detailed and exact to enable those skilled in the art to practice the invention, the physical embodiments herein disclosed merely exemplify the invention which may be embodied in other specific structures. The scope of the invention is defined in the claims appended hereto.

Referring now to FIG. 1 and FIG. 2, the carrying case 13 includes a tube 21 which serves as a cover and an insert 23 which fits within the tube 21. The tube 21 has a hollow interior and a closed end 25. The closed end 25 of the tube 21 may have perforations 27 through it. The perforations 27 provide ventilation into the tube 21 when the carrying case 13 is closed. Opposite from the closed end 25, the tube 21 has an open end 29. The tube 21, both as to its hollow interior and its exterior surface, can be shaped like the frustrum of a cone with the closed end 25 smaller than the open end 29. The tube 21 can also be cylindrical in shape which will result in the closed end 25 and the open end 29 being substantially the same size.

Similarly, as is also shown in FIG. 2, the insert 23 can also be shaped like the frustrum of a cone. The insert 23 has an outer end 31 and an inner end 33 and if shaped like a frustrum of a cone the outer end 31 is larger than the inner end 33. The outer end 31 has a centrally located extension 34. The insert 23 can also be cylindrically shaped. However, the shape of the insert 23 must be the same as the shape of the tube 21. Four flat surfaces 35 are formed longitudinally along the outside surface of the insert 23. Any two adjoining flat surfaces 35 of the four flat surfaces 35 are substantially located at right angles to one another. In this way two pairs of parallel flat surfaces 35 are formed, each pair of parallel flat surfaces 35 being at right angles to the other pair of parallel flat surfaces 35. A cap 36 is mounted on the outer end 31 of the insert 23. The cap 36 has an indentation 37 designed to fit the extension 34. The cap 36 also includes a sleeve 38 having an interior either conical or cylindrical in accordance with the shape of the insert 23. The cap 36 is separately formed apart from the outer end 31 of the insert 23. The sleeve 38 of the cap 36 forms with the portion of the insert 23 adjacent its outer end 31 a concentric channel 39 into which the open end 29 of the tube 21 extends. The sleeve 38 of the cap 36 extends along only a minor portion of the length of the insert 23 and the tube 21. When the tube 21 is in place within the channel 39 a small annular opening 40 remains between the tube 21 and the cap 36 to permit the circulation of air which is essential for controlled drying of the reeds being stored. A foam washer 41, made for example from rubber or polyurethane, is located concentrically about the extension 34.

The four flat surfaces 35 do not touch one another thereby leaving four ribs 42 to separate the flat surfaces 35 from one another. The ribs 42 extend longitudinally along at least a substantial portion of the insert 31. When a reed 43 is stored on one of the flat surfaces 35, the reed 43 extends under the cap 36 and in this manner, the delicate part of the reed 43 is, at least in part, protected by the cap 36 and is protected from damage by pressing against the cap 36 by the foam washer 41. In order to prevent the reeds 43 from falling out of position and being damaged when the tube 21 is removed, a flexible ring 44, preferably an O-ring, is snugly fitted over the insert 23. The flexible ring 44 is maintained in place by a groove 45 which is circumferentially oriented in the ribs 42. The flexible ring 44 also contacts the tube 21 thereby holding the tube 21 in place when it covers the insert 23.

An opening 46, preferably circular in cross-section, extends longitudinally from the inner end 33 of the insert 23 along the centerline of the insert 23. As best seen in FIG. 3, the opening 46 extends beneath the cap 36. The opening 46 can be used, if desired, for the storage of added accessories such as a container of lubricant (not shown) which is required for lubricating the various corks provided at the joints of the instrument.

The invention may be embodied in other specific forms without departing from the spirit or essential characteristics thereof. The present embodiments are, therefore, to be considered in all aspects as illustrative and not restrictive. The scope of the invention being indicated by the appended claims rather than the foregoing description and all changes which come within the meaning of range of equivalency of the claims are, therefore, intended to be embraced therein.

I claim:

1. A carrying case for reeds used with a woodwind instrument, said carrying case comprising:

an insert having an outer end and an inner end with a multiplicity of flat surfaces extending longitudinally along the outer surface of said insert between said outer end and said inner end;

a cap adapted to fit over the outer end of the insert; a flexible ring mounted about said insert for retaining reeds on the flat surfaces of the insert, said flexible ring also contacting said tube to secure said tube in place in the insert; and a tube having an open end and a closed end and adapted to receive the insert within it.

2. A carrying case according to claim 1 wherein said multiplicity of flat surfaces are four flat surfaces.

3. A carrying case according to claim 2 wherein said four flat surfaces are two pairs of flat surfaces with the flat surfaces of each pair substantially parallel to one another and the surfaces of each pair being substantially at right angles to the surfaces of the other pair.

4. A carrying case according to claim 1 wherein said tube has the shape of the frustrum of a cone.

5. A carrying case according to claim 1 wherein said insert has a circular opening extending along its centerline.

6. A carrying case according to claim 1 wherein said closed end of said tube has perforations through it.

7. A carrying case according to claim 3 wherein said insert has a circular opening along its centerline.

8. A carrying case according to claim 1 further including a foam washer located between said cap and said insert adjacent the ends of reeds located on the flat surfaces of the insert.

9. A carrying case according to claim 1 wherein said tube has the shape of a cylinder.

* * * * *